United States Patent [19]

Inman et al.

[11] 4,285,288

[45] Aug. 25, 1981

[54] TUFTING APPARATUS FOR PREVENTING SEW-THRU AND TAGGING

[75] Inventors: Billy E. Inman, Signal Mountain, Tenn.; Wheeler E. Phillips, Kensington, Ga.

[73] Assignee: Spencer Wright Industries, Inc., Chattanooga, Tenn.

[21] Appl. No.: 188,718

[22] Filed: Sep. 19, 1980

[51] Int. Cl.[3] ..... D05C 15/16

[52] U.S. Cl. ..... 112/79 R

[58] Field of Search ..... 112/79 R, 79 A, 79.5, 112/79 FF, 80, 261

[56] References Cited

U.S. PATENT DOCUMENTS

| | | | |
|---|---|---|---|
| 2,975,736 | 3/1961 | Card | 112/79 R |
| 3,074,362 | 1/1963 | Broadrick et al. | 112/79 R |
| 3,084,645 | 4/1963 | Card | 112/79 R |
| 4,134,347 | 1/1979 | Jolly et al. | 112/79 R |

*Primary Examiner*—H. Hampton Hunter

*Attorney, Agent, or Firm*—Alan Ruderman

[57] ABSTRACT

An oscillating wiper for a tufting machine has a bristle brush for sweeping loops shed by the looper away from the needle path and prevents the loops from springing back into the needle path thereby preventing sew-thru and tagging. The wiper is operatively carried by the knife shaft and oscillates therewith in timed relationship with the formation, seizing and shedding of the loops by the looper. The tufting machine disclosed is a level cut/loop machine in which the looper has a selectively pivotable gate member which opens to allow loops thereon to be cut by the knife and is selectively closed to shed loops to form uncut pile. The bristles of the wiper act on the uncut loops.

9 Claims, 6 Drawing Figures

TUFTING APPARATUS FOR PREVENTING SEW-THRU AND TAGGING

BACKGROUND OF THE INVENTION

This invention relates to tufting machines and more particularly to apparatus for preventing the needles from sewing through or tagging the previously formed loops as the needles reciprocate downwardly through the base fabric to form the successive loop.

Sew-thru is the situation in which the needle, as it descends to form a loop, enters a previously formed loop and in effect forms a chain stitch. A similar situation known as tagging occurs where the needle, rather than passing clearly through the previous loop spears some of the filaments. Both situations tend to occur in tufting machines producing loop pile under circumstances where either the twist of the yarn is such that the loop, upon being shed by the looper, curls or springs back under the path of the needle; the stitches formed per inch of base material is large such that the loops have not moved very far in the feed direction when the needle next penetrates the base fabric; or the pile height of the loops formed is relatively large and are not pulled back very far toward the base fabric thereby swinging into the needle path.

The accompanying sew-thru and tagging is not a problem in cut pile tufting machines because the previously formed loop remains on the looper, being prevented from entering the needle path by the barb on the tip of the cut pile looper. Moreover, even if the needle should spear such a previously formed loop the fact that the loops are later cut on the looper eliminates the visible aesthetic defects which clearly show on uncut loop pile.

Heretofore, although these problems exist they have not been of major significance in cut/loop tufting machines, i.e., those where loop pile and cut pile selectively are produced in the same row of stitching since the uncut loops of pile have been back-drawn from the seizing position toward the base fabric. Those machines, as illustrated in U.S. Pat. No. 3,084,645, back-draws the uncut loops past a spring clip on the looper while the cut loops, which are not back-drawn, remain on the looper and are cut. Thus, the uncut loops are shorter than the cut pile and generally the machine can be timed so that most loops do not significantly swing into the needle path. However, in the recent even level cut/loop pile machines, such as illustrated in U.S. Pat. No. 4,134,347, the loops which are prevented by the gate from entering the loopers are merely released and only drawn-back to substantially the level of the looper blade so that the uncut loops are substantially at the same level as the uncut pile. The pile height of tufted fabric produced with this construction is in the order of $\frac{3}{4}$ inch, relatively high pile resulting in more than an occasional sew-thru condition. The problem, of course becomes more acute as the pile height is increased. Moreover, this difficulty is exceptionally significant when the gauge of these machines has been decreased to one eighth.

The known prior art efforts to reduce tagging, are illustrated in U.S. Pat. Nos. 2,975,736; 3,074,362; and 3,316,867. In U.S. Pat. No. 2,975,736 a needle guide channel plate was proposed for a loop pile machine in an earlier stage in the development of the tufting art when the gauge was substantially larger than the gauge at the present stage and more space was available beneath the bedplate. In U.S. Pat. No. 3,074,362, a bristle brush fixedly mounted to the bedplate of a loop pile machine held the formed loops from curling back into the needle path. Being fixed, its applicability to a machine forming both cut and uncut pile presents difficulties and was unsuccessful when installed in a one eighth gauge level cut/loop machine. In U.S. Pat. No. 3,316,867 the head of the machine is inclined to alter the path of the needle and thus was not found to be a practical solution.

SUMMARY OF THE INVENTION

The present invention provides apparatus for preventing sew-thru and tagging, especially for cut/loop tufting machines, by cyclically driving a wiper across the needle path to sweep and maintain the previously formed loops away from the needle path as the needles penetrate the base material. The wiper is constructed to allow the needles to deflect or penetrate its structure readily without themselves deflecting and, to this end, preferably comprises a member carrying a series of bristles easily deflected and penetrated by the needles. Oscillation of the wiper occurs in timed relationship with the needles and loopers. This is provided in cut/-loop machines by supporting the wiper for movement with the knife shaft. As the knives rock toward cutting relation with the loopers the wiper pushes or sweeps the loop previously shed by the looper away from the needle path. As the needles descend to form the subsequent loop the wiper is moving away from the loop but still deflecting the prior loops from the needle path. The needles penetrate the structure of the wiper but not the prior loops. The loopers thereafter seize and maintain the loop, if it is to be cut, or shed the loop if it is to remain uncut. In either instance as the looper rocks away from the needle path the knives rock toward the loopers and the wiper sweeps or pushes the loops that are shed by the loopers.

Consequently, it is a primary object of the present invention to provide improved means for eliminating sew-thru and tagging in a tufting machine.

It is another object of the present invention to provide in a tufting machine an oscillating wiper for sweeping or pushing loops shed by the loopers out of the path of the needles so that the needles do not engage the shed loop as the needles descend to form subsequent loops.

It is a further object of the present invention to provide in a tufting maching having oscillating loop cutting knife means an oscillating wiper driven in timed relationship with the knife means, the wiper acting to prevent loops from curling or springing into the path of the needle.

It is a still further object of the present invention to provide in a tufting machine an oscillating wiper readily deflected by or penetrated by the descending needles, the wiper acting to prevent previously formed loops from swinging back into the needle path.

It is yet a still further object of the present invention to provide in a cut/loop tufting machine a loop wiper operatively driven by the knife drive member for sweeping and holding a shed loop to avoid needle contact as the needle descends to form successive loops.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
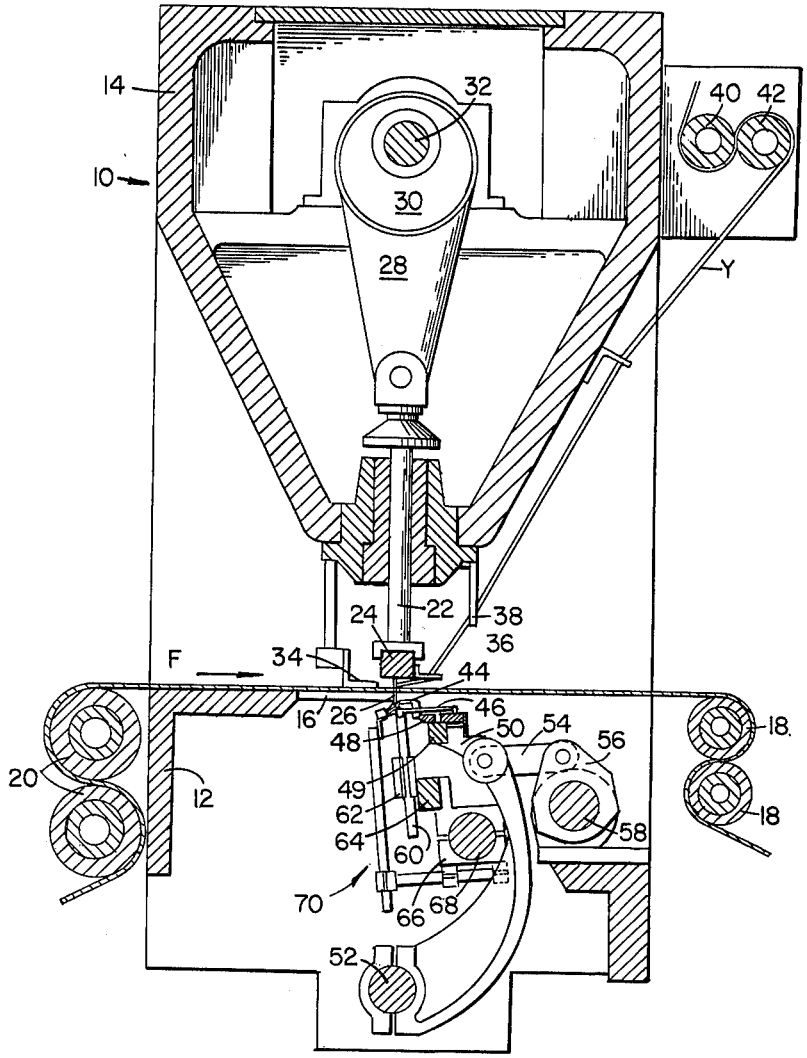
FIG. 1 is a vertical sectional view taken transversely through a multiple needle even level cut/loop tufting machine embodying loop wiper apparatus constructed in accordance with the principles of the present invention.

Referring now to the drawings, there is illustrated in FIG. 1 a tufting machine 10 having a frame comprising a bed 12 and a head 14 disposed above the bed. The bed 12 includes a bedplate 16 across which a fabric F is adapted to be fed by a pair of feed rolls 18 and take-off rolls 20.

Mounted in the head 14 for vertical reciprocation is one of a plurality of push rods 22 to the lower end of which a needle bar 24 is carried and which in turn carries a plurality of needles 26 that are adapted to penetrate the fabric F through fingers on the bedplate 16 upon reciprocation of the needle bar 24 to project loops of yarn Y therethrough. Endwise reciprocation is imparted to the push rods 22 and thus the needle bar 24 and needles 26 by a link 28 which is pivotably connected at its lower end to the push rods 22 and its upper end to an eccentric 30 on a driven rotary main shaft 32 that is journalled longitudinally in the head 14. A presser foot assembly 34 may be supported on the head 14 to hold down the fabric F during needle retraction. A yarn-jerker 36 is carried by the needle bar 24 and operates to engage the yarn between a stationary yarn guide 38 on the frame of the machine and the needle 26.

Yarn Y is supplied to each needle 26 by any conventional type of yarn feed mechanism such as feed rolls 40 and 42 adapted to be continuously rotated by any convenient means, preferably synchronized with the main shaft 32, to continuously feed fixed lengths of yarn to the needles.

Mounted within the bed for cooperation with the needles to seize loops of yarns presented thereby are a plurality of loopers 44 which point in the direction opposite to that to which the fabric is fed and have pivotable gate members 46 controllably operated to open or close the entry of a loop of yarn from the bill of the looper onto the blade. For a complete description of the operation of the gate and the control therefor reference is made to U.S. Pat. No. 4,134,347 assigned to the common assignee of the present invention. The hooks have mounting portions that are mounted in looper bars 48 carried by a mounting bar 49 secured to the upper end of a rocker arm 50. Any conventional means to oscillate the arm 50 may be provided. In the preferred embodiment the lower end of the rocker arm 50 is clamped to a laterally extending rock shaft 52 journalled in the bed. Pivotably connected to the upper portion of the rocker arm 50 is one end of a connecting link 54 having its other end pivotably connected between forked arms of a jack shaft rocker arm 56. The arm 56 is clamped to a jack shaft 58 which has oscillating motion imparted thereto by conventional drive means such as a cam and lever means (not shown) from the main shaft 32 in timed relationship with the reciprocation of the needles. The tufting machine incorporates a plurality of knives 60 which may cooperate with the loopers to cut selected loops to form cut pile as described in the aforesaid U.S. Pat. No. 4,134,347. The knives may be mounted in knife blocks 62 secured to a knife bar 64 which in turn is secured to a knife shaft rocker arm 66 clamped to a knife shaft 68. Oscillatory movement is imparted to the knife shaft 68 in timed relationship with the oscillation of the loopers and the reciprocation of the needles to conventionally drive the knives into engagement with one side of the respective loopers as known in the art to provide a scissors-like cutting action.

During the operation of the machine the needles descend to form a loop and the loopers rock forwardly toward the needle path so that the bill or points of the loopers enters and seizes the respective loops. If the pattern to be tufted calls for the stitch to be a cut pile the gate opens and the loop enters the blade of the looper and gradually moves rearwardly where it is cut by the knife. If the pattern calls for an uncut loop the gate is closed and the seized loop, prevented from entering the blade of the looper, is shed as a looper rocks away from the needle path. The loop in both instances is jerked upwardly to the level of the looper blade by the feed system which feeds less yarn to the system than that adequate to accomodate the requirements thereof as fully explained in the aforesaid U.S. Pat. No. 4,134,347. As heretofore stated, when the pile height is in the order of approximately $\frac{3}{4}$ of an inch or more and despite the fact that the loop is moving with the base fabric away from the needle path, the uncut loops that are shed by the looper have a tendency to curl or spring back into the needle path. This tendency is increased if the number of stitches formed per inch of fabric feed is increased since the fabric and loop do not move very far before the next needle penetration of the fabric. Again this problem is increased as the gauge of the machine is decreased. To overcome this difficulty the present invention provides a wiper assembly generally indicated at 70 in FIG. 1 which cyclically pushes or sweeps the shed loops to prevent them from springing back into the needle path.

Figure 2:
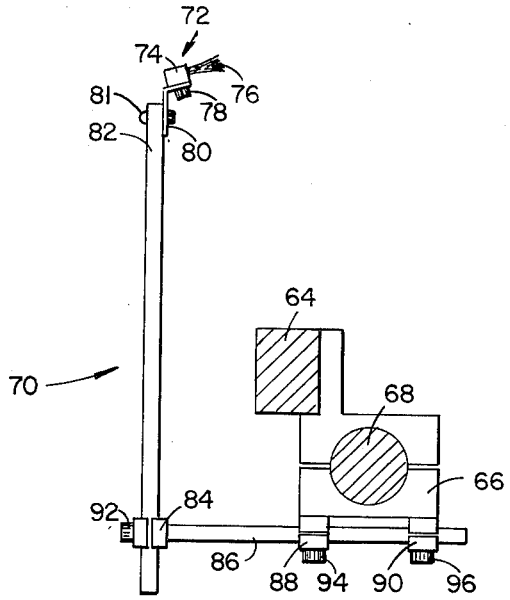
FIG. 2 is an end vertical sectional view of the wiper mechanism supported by the knife shaft and, for purposes of illustration, diassociated from the tufting machine.
Figure 3:
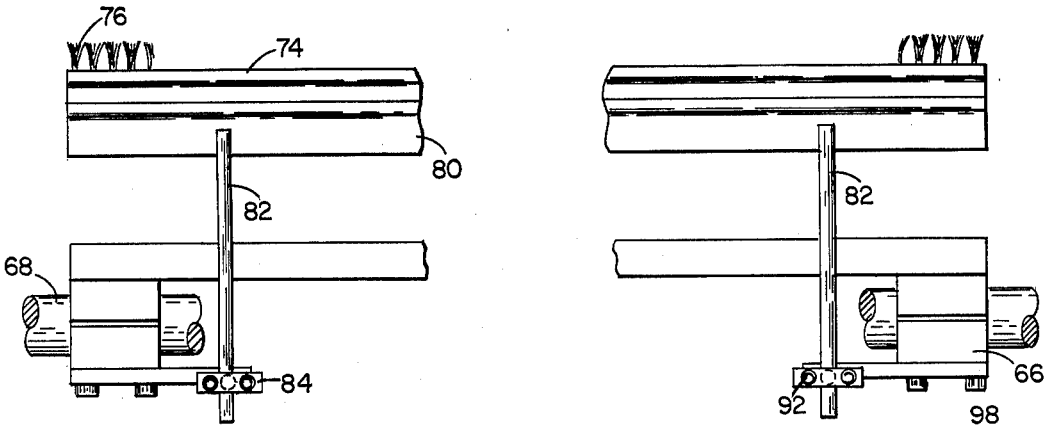
FIG. 3 is a side elevational view of the wiper mechanism as viewed from the left side of FIG. 2.

With reference to FIG. 2 the wiper assembly comprises a wiper member 72 which may be a transverse length of material such as rubber or the like readily deflectable when contacted by the needles or a piece of such material with a series of slits so that the needles may readily penetrate it without themselves deflecting as the needles descend. However, in the preferred embodiment the wiper member 72 comprises a brush 74 having bristles 76 which the needles easily and readily deflect and penetrate without deflection of the needles. The density of the bristles should be such that a substantially continuous bristle surface is presented so that no loop can swing back into the needle path. The material of the bristles is uncritical and a conventional brush having plastic bristles has been found to provide good results. The frame of the brush 74 is secured as by fastening screw means 78 to a bracket member 80 which is in turn secured by fastening means such as bolts 81, or by a weld, to respective upstanding rods 82 spaced apart transversely. A split clamping block 84 is secured to each of the rods remote from the wiper 72 and each block 84 is secured to a rod 86 which in turn is secured to clamping members 88, 90 to the knife shaft rocker arm 66. Screw means 92 in association with the clamping block 84 permits vertical adjustment of the rods 82 relatively to the rods 86 and screw means 94 and 96 permit lateral adjustment of the rods 86 and thus the wiper relatively to the knife shaft. Thus, the wiper can be adjustably positioned relatively to the loops that have been shed and cyclically oscillate with the knives.

Figure 4:
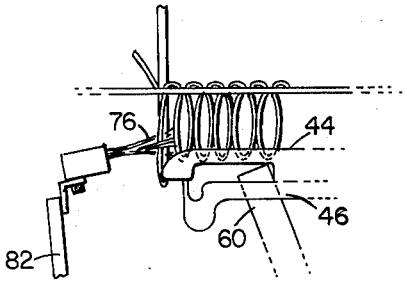
FIG. 4 is a diagrammatic view of a first operative position of the wiper relatively to the looper and needle.
Figure 5:
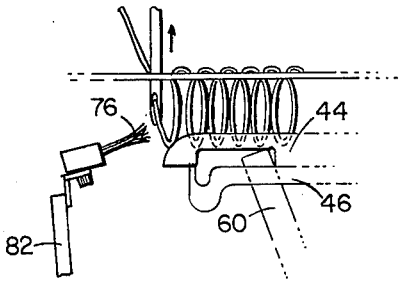
FIG. 5 is a view similar to FIG. 4 showing a second operational position.
Figure 6:
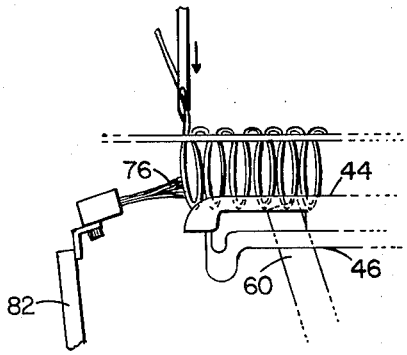
FIG. 6 is a view similar to FIG. 4 illustrating a third operative position of the wiper needle and looper.

In operation, with reference to FIGS. 4 through 6, as the needles begin to descend the knives, which have closed on the loopers to cut the last loops thereon, begin to oscillate away in the direction opposite to that of fabric feed. The wiper, being supported by the knife shaft, thus begins to move from its furthest position in the direction of fabric feed, where it has pushed or swept a last shed loop, toward the other direction. The amount of rocking movement of the knives and wiper is small and the wiper bristles remain in the needle path and prevent springing back of the last loop. At the bottom of the needle stroke the looper has moved forwardly toward the needle path to seize the subsequent loop. The knives at this time are open relatively to the loopers to allow any loop on the looper blade to move rearwardly and the wiper is thus substantially in its furthest position to the left as illustrated in the figures from the needle path. As the needles ascend the knives start to close, the loopers rock rearwardly, and the brush moves toward the loopers. As the loops seized by the looper is shed by a closed gate looper and drawn up by its needle, the wiper while moving forwardly toward the feed direction sweeps the loop in the feed direction away from the needle path and prevents the loop from springing toward the needle path as the cycle repeats.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. In a tufting machine, means for feeding a base fabric in one direction, at least one yarn carrying needle supported on one side of the base fabric, means for reciprocating said needle for penetrating said fabric to present loops of yarn therein, looper means disposed on the other side of said fabric, and means for oscillating said looper means in timed relationship with said needle toward and away from cooperation with said needle for seizing successive loops of yarn presented thereby and for shedding at least some of said loops, the improvement comprising, a wiper disposed on said other side of said fabric and facing in said one direction, means for oscillating said wiper in timed relationship with said needle in a path transverse to the path of said needle for sweeping loops shed by said looper into said one direction away from the path of the needle and for precluding said shed loops from entering the path of said needle as the needle penetrates said fabric, said wiper comprising means readily deflectible when engaged by said needle.

2. In a tufting machine as recited in claim 1, wherein said wiper comprises a series of bristles.

3. In a tufting machine as recited in claim 1, wherein said wiper is disposed closer to said base fabric than said looper means.

4. In a tufting machine as recited in claim 1, including a knife cooperating with said looper means for cutting loops of yarn on the looper means not shed thereby, means including a rocker shaft for oscillating said knife in timed relationship with said looper means into and out of cutting engagement with said looper means, and wherein said means for oscillating said wiper comprises means for mounting said wiper on said rocker shaft.

5. In a tufting machine as recited in claim 4, wherein said wiper comprises a series of bristles.

6. In a tufting machine as recited in claim 5, wherein said means for mounting said wiper on said rocker shaft comprises first rod means, means for adjustably securing said first rod means to said rocker shaft extending generally opposite to said one direction, second rod means, means for adjustably securing said second rod means to said first rod means extending toward said base fabric, and means for securing said wiper to said second rod means.

7. In the method of tufting pile fabric including the steps of supporting and feeding a base fabric in one direction, actuating a needle in a reciprocating path to stitch a yarn continuously through said base fabric as the fabric moves to form a row of successive yarn loops on one side of said fabric, and supporting upon said one side of said fabric an oscillating looper having a free end for entering and seizing loops in succession and for shedding at least some of said loops, the improvement comprising supporting upon said one side of said fabric a wiper pointing in said one direction and oscillating said wiper across said path of said needle to sweep each shed loop in succession in said one direction and to maintain said shed loop out of said path of said needle.

8. In the method as recited in claim 7, including supporting upon said one side of said fabric a knife for severing loops not shed by said looper, oscillating said knife into and out of cutting engagement with said looper, and wherein said wiper oscillates together with said knife.

9. In the method as recited in claim 8, wherein said wiper commences movement toward said one direction as said needle while in said base material is at substantially one extreme of the needle path, and the wiper commences movement toward the direction opposite said one direction as the needle while external to said base material is at substantially the other extreme of the needle path.

* * * * *